US005669122A

United States Patent [19]

Benoit

[11] Patent Number: 5,669,122

[45] Date of Patent: Sep. 23, 1997

[54] TIGHTENING LEVER WITH ADJUSTABLE HOOK

[75] Inventor: Louis Benoit, La Balme De Sillingy, France

[73] Assignee: Salomon S.A., France

[21] Appl. No.: 639,752

[22] Filed: Apr. 29, 1996

[30] Foreign Application Priority Data

Apr. 27, 1995 [FR] France ..... 95 05248

[51] Int. Cl.[6] ..... A43C 11/14

[52] U.S. Cl. ..... 24/71 SK; 24/70 SK; 24/71 R

[58] Field of Search ..... 24/71 SK, 70 SK, 24/71 R, 71 T, 69 SK, 68 T, 68 SK, 68 R

[56] References Cited

U.S. PATENT DOCUMENTS

| | | | |
|---|---|---|---|
| 513,727 | 1/1894 | Potts | 24/71 SK |
| 4,395,801 | 8/1983 | Gabrielli | 24/70 SK |
| 4,470,175 | 9/1984 | Chiarella | 24/71 SK |
| 4,651,392 | 3/1987 | Oliveri | 24/71 SK |
| 5,383,258 | 1/1995 | Nicoletti | 24/70 SK |
| 5,526,555 | 6/1996 | Battistella | 24/71 SK |

FOREIGN PATENT DOCUMENTS

| | | | |
|---|---|---|---|
| 524570 | 1/1993 | European Pat. Off. | 24/69 SK |
| 1330272 | 5/1963 | France | 24/70 SK |
| 1395510 | 3/1965 | France | 24/71 SK |

*Primary Examiner*—Peter M. Cuomo
*Assistant Examiner*—Hanh V. Tran
*Attorney, Agent, or Firm*—Pollock, Vande Sande & Priddy, R.L.L.P.

[57] ABSTRACT

A device for closing a boot, in particular a ski boot, designed to hold two sections of the boot together and comprising, first, a control lever carried by a plate made integral with one of the sections to be joined together, and second, on the other section, a rack, in one of the teeth of which a hooking device is designed to be engaged, this device being connected to the control lever by an inextensible tie rod. The hooking device has two hooking ends and is connected to the tie rod by a connection block on a pin belonging to which it rotates asymmetrically in a plane substantially parallel to that of the boot surface, the hooking ends being equipped with catches.

7 Claims, 2 Drawing Sheets

TIGHTENING LEVER WITH ADJUSTABLE HOOK

FIELD OF THE INVENTION

The invention concerns a device for closing a boot, in particular a ski boot. In conventional fashion, such devices are used to tighten two sections, or flaps, of a shell around a sock in which the skier's foot is placed. More particularly, the invention relates to closing devices utilizing a rocker-arm control lever and a rack, which allows at least approximate adjustment of the length of the device.

BACKGROUND OF THE INVENTION

Italian patent No. 61 930 B88 describes a device of the aforementioned type, in which the rack comprises a number of teeth, at least one of which cooperates with a hooking device connected to the control lever by means of an inextensible tie rod.

According to this document, the hooking device is constituted by a part whose ends are folded down in relation to a flat reference surface so as to form a U, its ends forming catches capable of cooperating either individually with one of the teeth belonging to the rack, or simultaneously with two end teeth belonging to a group of teeth incorporated into this rack. In this latter case, the catches of the U-shaped hooking device will be spaced apart by a distance equal to the number of teeth of the rack it covers.

This arrangement is designed to permit adjustment by a value equal to the course of travel corresponding to the number of teeth belonging to the rack, this value being supplemented by the spacing of the hooking device, both when it is in a maximum released position by virtue of one of the end catches on a first tooth of the rack, and when it is in a maximum tightened position by virtue of the catch of the aforementioned locking device on a last tooth on the rack.

While a device of this kind in fact increases the adjustment course of travel, this latter nevertheless has its limits, since the length of the locking device must remain reasonable because of the space required, and also for aesthetic reasons.

Another device of this type is described in French Patent No. 2 373 981, in which the hooking device is constituted by an element which can be reversed around a transverse pin parallel to the plane of the length of the boot, this element being asymmetrical in relation to the pin and being supported by one or the other of its ends on a stationary part of one of the flaps of the boot. In this case, the rack carded by the other flap permits a range of adjustment equal to the number of teeth thereof, increased by the value of the asymmetry of the reversible element.

In this case, although an increased adjustment course of travel is produced, one major disadvantage lies in the fact that it actually necessitates a dual-level adjustment, one at the rack carried by one of the flaps, the other on the hooking device carried by the other flap, thereby making adjustment tedious and more time-consuming.

Moreover, this device runs counter to a technological trend seeking maximum integration of the control means in relation to the enveloping surface of the boot.

This is not the case in the device just described, in which the reversal of the locking device takes place in a space corresponding to the rotation thereof.

SUMMARY OF THE INVENTION

The present invention is intended to make it possible to increase the adjustment course of travel by adding or taking away more or less to or from the nominal adjustment, in order to produce a total enlarged area, during both a boot-tightening and a boot-releasing operation, while remaining as close as possible to the enveloping surface of the boot, in order not to exacerbate the risks of damage by virtue of its raised position.

To this end, the invention concerns a device for closing a boot, in particular a ski boot, designed to hold two sections of the boot in close proximity and comprising a control lever carried by a plate connected integrally to one of the sections to be drawn closer to the other section, and, on the other section, a rack in one of whose teeth a hooking device is designed to be engaged, this device being connected to the control lever by an inextensible tie rod hooking device is connected to the tie rod by means of a connection block, on a pin in which it rotates asymmetrically in a plane substantially parallel to that of the boot surface.

BRIEF DESCRIPTION OF THE DRAWINGS

The following description, provided by way of example, will make clearer how the invention can be produced, with reference to the attached drawings in which.

DETAILED DESCRIPTION

Figure 1:
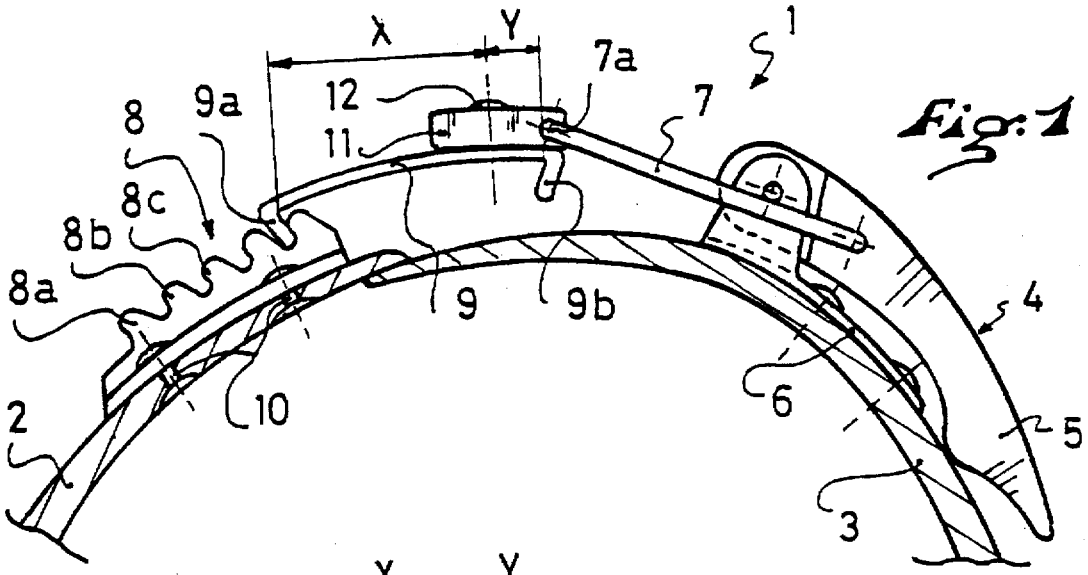
FIG. 1 is an overall lateral view of a first embodiment of the device for closing a boot, in a minimum tightening position.
Figure 2:
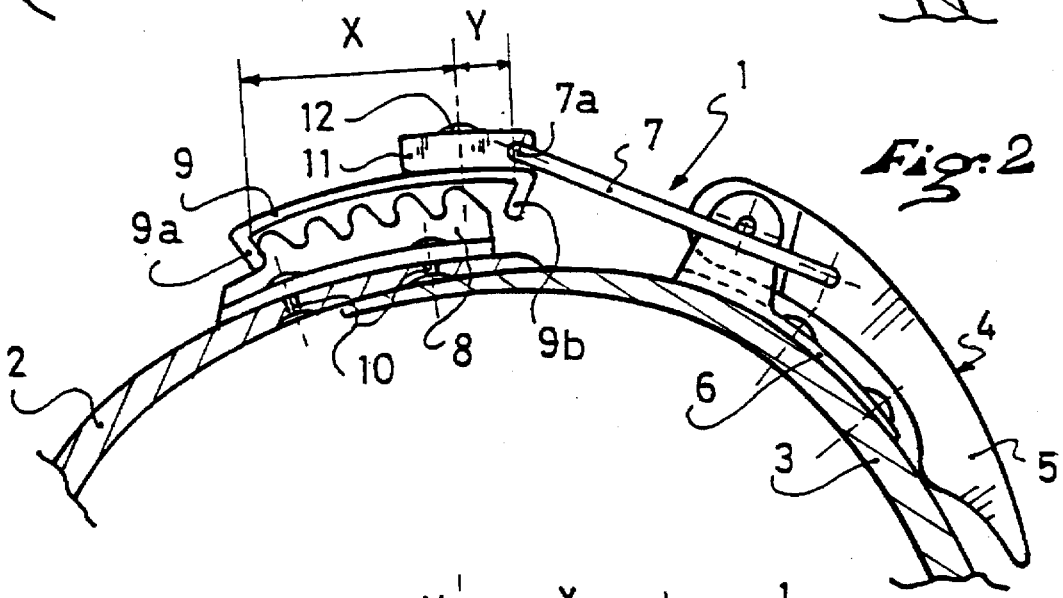
FIG. 2 is a view similar to FIG. 1, in which the device is shown in an intermediate tightening position.
Figure 3:
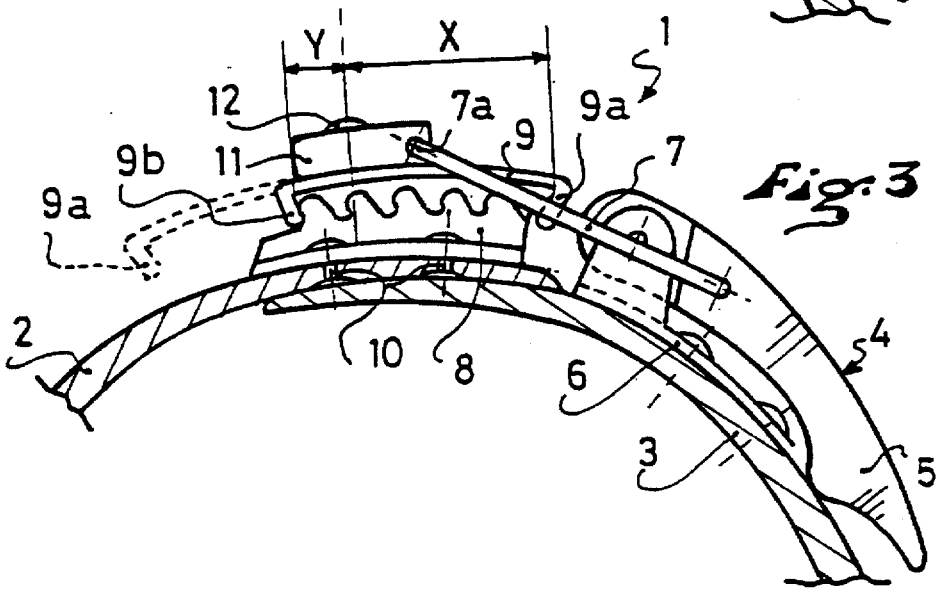
FIG. 3 is a view similar to FIG. 1, in which the device is shown in a maximum tightening position.

In accordance with the embodiment illustrated in the drawings, the closing device 1 is designed to draw two sections of the boot 2 and 3 into proximity with each other.

The device 1 comprises a rocker-arm control lever 4. This conventionally-known lever 4 comprises an arm 5 connected to the section 3 of the boot, by means of a plate 6. An inextensible tie rod 7 is fastened and jointed to the arm 5 of the lever and is designed to be connected to a rack 8 by means of a hooking device 9 cooperating with at least one of the teeth 8*a*, 8*b*, 8*c*, etc. of this rack. The rack 8 is fastened in conventional fashion to the other section 2 of the boot using rivets 10.

According to the invention, the device for closing a boot, in particular a ski boot, is intended to hold two sections 2, 3 of the boot in close proximity to each other, and comprises, a control lever 4 carried by a plate 6 made integral with one of the sections 3 to be joined, and a rack 8, in one of whose teeth 8*a*, 8*b*, 8*c*, etc., a hooking device 9 is designed to be engaged, this device being connected to the control lever 4 by an inextensible tie rod 7. The hooking device 9 is connected to the tie rod 7 by means of a connection block 11, and rotates asymmetrically on a pin in this block in a plane substantially parallel to that of the boot surface.

As illustrated in the drawings, the rotational pin 12 allowing the hooking device 9 to rotate on the block 11 is interposed between the hooking device and the block perpendicularly to their plane, and it ensures that they are jointed together.

In the illustrated embodiment, the rotational pin 12 of the hooking device 9 is mounted in stationary fashion on the block 11; however, it could also, conversely, be fastened to the hooking device 9 and be free to rotate in the block 11.

The block 11 is a relatively flat element extending parallel to the hooking device 9, one of its ends carrying the rotational pin 12 of the latter, while the other end of this block 11 has running through it, in a direction also parallel to the plane of the boot surface, a transverse pin 7*a* allowing attachment to the tie rod 7.

The hooking device 7 comprises, at its ends located in the axis of traction of the tie rod 9, two catches 9*a*, 9*b* curved downward toward the rack 8, 8A, which they are designed to engage, and asymmetrically located in relation to the rotational pin 12 of the hooking device 9. In the illustrated embodiment, the catch 9*a* is separated from the pin 12 by a X greater than the distance Y separating the pin from the catch 9*b*. Accordingly, after pivoting the hooking device by 180° around the pin 12, the cooperation of one or the other of the catches 9*a*, 9*b* with a particular tooth 8*a*, 8*b*, 8*c*, etc., of the rack 8, 8A gives two tightening adjustments, the difference between which is equal to that of the offset configuration X-Y of the aforementioned catches 9*a*, 9*b* in relation to the pin 12, the overall range of adjustment between a maximum and a minimum value being equal to the range given by operating the control lever 4, to which the difference of the offset X-Y is added.

It will be understood that it is possible to establish any value for the relationship between the greater length X corresponding to the distance separating the end 9*a* from the pin 12, and the smaller length Y separating the end 9*b* from this pin 12.

It is important to note here that, while this arrangement allows an increase of the X-Y adjustment, this same increase can, in fact, be obtained when both minimum and maximum tightening of the boot is effected by exerting traction on its sections 2 and 3.

According to this embodiment, the hooking device 9 is constituted by a relatively flat piece of sheet metal, whose catches 9*a*, 9*b* are constituted by two transverse folded-down end pieces capable of cooperating with teeth 8*a*, 8*b*, 8*c*, etc., belonging to the rack.

To ensure better engagement with these teeth, they form an angle of less than 90° in relation to the upper plane of the hooking device 9.

Figure 4:
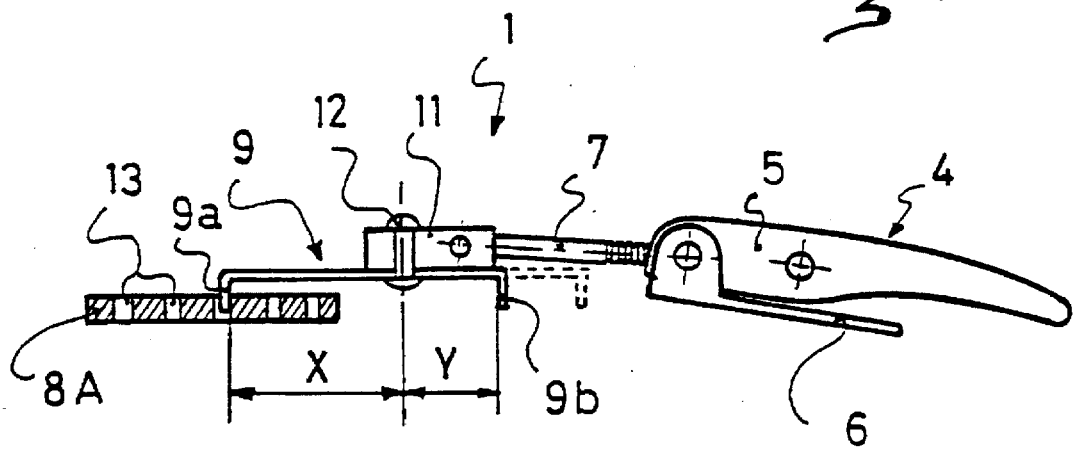
FIG. 4 is a second embodiment of the lateral view of a closing device.
Figure 5:
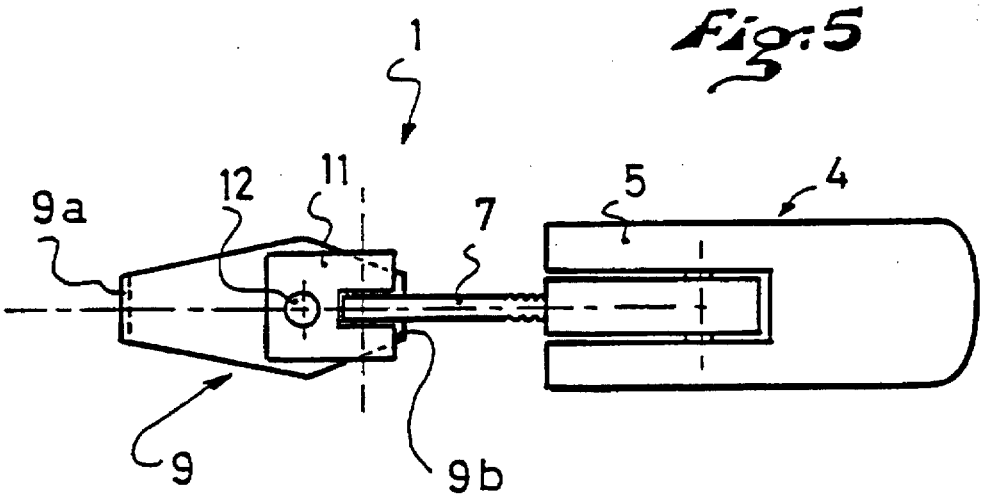
FIG. 5 is a top plan view of the device in FIG. 4.

According to a variant illustrated in FIG. 4, the hooking device 9 is constituted by a relatively flat sheet-metal piece whose catches 9*a*, 9*b* can cooperate with holes 13 drilled in a flat element 8A forming a rack, the holes 13 constituting the equivalent of the catches between teeth 8*a*, 8*b*, 8*c*, etc.

Other variants are also possible. For example, the hooking device 9 could have the form of a buckle or a sheet-metal plate provided with two transverse slots for cooperation with the rack 8.

What is claimed is:

1. A device for closing a boot having two sections by drawing and holding said sections together, said device comprising (a) a control lever carried by a plate adapted to be integral with a first one of said sections;

(b) a rack adapted to be carried by a second one of said sections;

(c) a hooking device connected to said control lever, via a connection block, by an inextensible tie rod;

(d) said hooking device having first and second hooking ends adapted to engage in said rack;

(e) said hooking device being rotating asymmetrically about a pin in said connection block in a plane substantially parallel to a plane of a surface of said boot;

(f) said first end of said hooking device being separated from said pin by a first distance greater than a second distance by which said second end of said hooking device is separated from said pin.

2. A device according to claim 1, wherein said pin is interposed between said hooking device and said connection block perpendicularly to a plane of said hooking device and said connection block and assures their articulated connection.

3. A device according to claim 1, wherein said connection block is a substantially flat element extending parallel to said hooking device, and is attached to said tie rod by means of a transverse pin traversing an end of said connection block parallel to said plane of said surface of said boot.

4. A device according to claim 1, wherein said first and second hooking ends of said hooking device are bent downwardly toward said rack and are located in an axis of traction of said tie rod.

5. A device according to claim 1, wherein said rack comprises a plurality of teeth separated by slots, and one of said first and second hooking ends is adapted to engage in one of said slots, thereby producing, upon rotation of said device about said pin by about 180°, two tightening adjustments differing by an amount of offset positioning of said first and second hooking ends in relation to said pin, a total range of adjustments between maximum and minimum values being equal to a range provided by operation of said control lever, plus a difference of said offset.

6. A device according to claim 5, wherein said hooking device is constituted by a substantially flat piece of sheet metal, and said hooking ends are constituted by two transverse folded-down end pieces adapted to engage between said teeth of said rack.

7. A device according to claim 5, wherein said hooking device is constituted by a substantially flat piece of sheet metal, and said rack is a substantially flat element traversed by spaced apertures in which said hooking ends are adapted to engage.

* * * * *